US007172198B2

(12) United States Patent
Parham

(10) Patent No.: US 7,172,198 B2
(45) Date of Patent: Feb. 6, 2007

(54) PARLAY POKER

(76) Inventor: Tyler Thomas Parham, 1205 Haskell St., Reno, NV (US) 89509

( * ) Notice: Subject to any disclaimer, the term of this patent is extended or adjusted under 35 U.S.C. 154(b) by 0 days.

(21) Appl. No.: 10/382,743

(22) Filed: Mar. 4, 2003

(65) Prior Publication Data

US 2003/0173742 A1 Sep. 18, 2003

Related U.S. Application Data

(60) Provisional application No. 60/360,877, filed on Mar. 4, 2002.

(51) Int. Cl.
*A63F 1/00* (2006.01)

(52) U.S. Cl. ..... 273/292; 273/274; 463/13

(58) Field of Classification Search ..... 273/292, 273/274, 309; 463/13, 12, 25–28
See application file for complete search history.

(56) References Cited

U.S. PATENT DOCUMENTS 5,823,873 A 10/1998 Moody ..... 463/13
6,045,129 A 4/2000 Cooper ..... 273/292
6,050,568 A 4/2000 Hachquet ..... 273/292
6,135,883 A * 10/2000 Hachquet ..... 463/13
6,334,613 B1 * 1/2002 Yoseloff ..... 273/292
6,419,578 B1 * 7/2002 Moody et al. ..... 463/13
6,474,645 B2 * 11/2002 Tarantino ..... 273/274
6,517,074 B1 2/2003 Moody ..... 273/292
6,568,680 B1 * 5/2003 Moody et al. ..... 273/292
2003/0100357 A1 * 5/2003 Walker et al. ..... 463/16

* cited by examiner

*Primary Examiner*—Benjamin H. Layno

(57) ABSTRACT

A player makes a wager and initiates game play, dealing a first hand of at least five cards all face up to the player. The player may hold none, one or more of the face up cards and draw replacement cards for the unheld cards. The player also has the options to wager on and duplicate none, one or more of the dealt cards into one or more five-card hands. If the player holds none of the cards and duplicates the dealt cards only, the player can hold the cards in the dealt hand and the duplicated hands in any traditional manner the player selects. The player is also given the option to select none, one or more winning outcomes for one or more of the five card hands.

2 Claims, No Drawings

PARLAY POKER

CROSS-REFERENCE TO RELATED APPLICATION

This application claims the benefit of U.S. Provisional Application Ser. No. 60/360,877, filed Mar. 4, 2002.

BACKGROUND OF THE INVENTION

This application relates to a method of playing a poker game, and more particularly to a method of playing a poker type game that provides the player with multiple game play options that create additional betting opportunities.

DETAILED DESCRIPTION OF THE PREFERRED EMBODIMENTS

The method of the present invention allows a player to wager on and play a poker type game. After the deal of at least five cards all face up, the player is presented with multiple game play options that create additional betting opportunities.

The player makes a wager and initiates game play, dealing a first hand of at least five cards all face up to the player. The player now has the traditional options to hold none, one or more of the face up cards and to select to draw replacement cards for the unheld cards.

Furthermore by utilizing the method of the present invention, the player also has the options to wager on and duplicate none, one or more of the dealt cards into one or more five-card hands. If the player holds none of the cards and duplicates the dealt cards only, the player can hold the cards in the dealt hand and the duplicated hands in any traditional manner the player selects. The player is also given the option to select none, one or more winning outcomes for one or more of the five card hands.

After the player has selected one or more options the player selects draw. Replacement cards for the non-selected cards are dealt into the dealt hand and the duplicated hands and all the options are played out. The player is then paid for any winning poker hands or winning outcomes selected by the player that match the poker hands dealt based on at least one pay table and at least one wager.

There are too many combinations of player options to list them all. So in order for some one skilled in the art to understand the invention, some of the options will be described below.

The player makes a wager and initiates game play, dealing a first hand of at least five cards all face up. After the only deal in the game, below are some of the options and combinations of options available for the player to select.

1. The player holds none, one or more of the first hand cards and selects draw.
2. The player holds one or more of the first hand cards and duplicates the held cards one or more times and selects draw.
3. The player duplicates the first hand cards one or more times. The player selects none, one or more of the first hand cards and each duplicated hand and selects draw.
4. The player selects none, one or more of the first hand cards. The player selects one or more winning outcomes and selects draw.
5. The player selects one or more of the first hand cards and duplicates the selected cards one or more times. The player selects one or more winning outcomes and selects draw.

6. The player duplicates the first hand cards one or more times. The player selects none, one or more of the first hand cards and each duplicated hand. The player selects one or more winning outcomes and selects draw.

The game allows the player to select one deal and one draw, even though the game draws additional cards for each duplicated hands from its own 52-card deck.

Separate pay tables are utilized for the different player options. See below.

Players are not paid for winning combinations duplicate from the first hand.

Players are only paid the winning combinations from the player options selected that are different than or greater than what is dealt from the first hand of cards.

The pay table for the winning combinations of the player options changes according to the cards dealt in the first hand and/or the number of player options selected.

The common threads in the poker game are:

The player makes a wager and initiates game play, dealing a first hand of at least five cards all face up.

The player selects one or more of the player options described above and selects draw.

All the hands and options are played out.

The player is paid for the winning outcomes of the options selected.

A further example of the present invention:

The player wagers 5 credits on a Jack or Better video poker game (pay table shown below). The player initiates game play and five cards are dealt face up.

Dealt Hand: 2 of Hearts, 2 of Clubs, 4 of Hearts, 5 of Hearts and 6 of Hearts.

The player now has a decision to make:

Hold the 2 of Hearts and 2 of Clubs and go for a possible three of a kind, four of a kind, full house or two pairs.

Hold the 2 of Hearts, 4 of Hearts, 5 of Hearts and 6 of Hearts and go for a possible inside straight, straight flush or flush.

The player has can select none or any one or more of the dealt cards to hold, but the two best strategies are described above. In traditional poker the player can only apply one strategy in order to draw a winning combination. But in the method of the present invention the player has the option to duplicate none, one or more of the dealt cards and also to select one or more of the winning outcomes of one or more hands before the draw.

The player selects to duplicate his hand once and places an additional 5-credit wager on the duplicated hand and places an additional 5-credit wager on that the winning outcome will be a straight flush in the duplicated hand.

Before the Draw

Dealt Hand: 2 of Hearts, 2 of Clubs, 4 of Hearts, 5 of Hearts and 6 of Hearts.

Duplicated Hand: 2 of Hearts, 2 of Clubs, 4 of Hearts, 5 of Hearts and 6 of Hearts.

The player holds the 2 of Hearts and 2 of Clubs in the dealt hand and the 2 of Hearts, 4 of Hearts, 5 of Hearts and 6 of Hearts in the duplicated hand and selects draw.

After the Draw

Dealt Hand: 2 of Hearts, 2 of Clubs, 4 of Spades, 7 of Hearts and 10 of Hearts.

Duplicated Hand: 2 of Hearts, 3 of Hearts, 4 of Hearts, 5 of Hearts and 6 of Hearts.

The player loses on the first hand. The player wins 200 credits on the duplicated hand with a straight flush and wins 200 credits on selecting the correct winning outcome.

Representative pay tables are set forth below. Table 1 shows a suitable pay table that is used with the initially dealt first hand when playing a basic Jacks or Better poker format.

TABLE 1

JACKS OR BETTER DRAW POKER

| | NUMBER OF COINS WAGERED | | | | |
|---|---|---|---|---|---|
| POKER HAND RANKING | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5 |

Table 2 shows a suitable pay table that is used with the duplicated second hand when playing a basic Jacks or Better poker format.

TABLE 2

JACKS OR BETTER DRAW POKER

| | NUMBER OF COINS WAGERED | | | | |
|---|---|---|---|---|---|
| POKER HAND RANKING | 1 | 2 | 3 | 4 | 5 |
| ROYAL FLUSH | 125 | 250 | 500 | 750 | 1000 |
| STRAIGHT FLUSH | 25 | 50 | 100 | 150 | 200 |
| FOUR-OF-A-KIND | 12 | 25 | 50 | 75 | 100 |
| FULL HOUSE | 5 | 9 | 18 | 27 | 36 |
| FLUSH | 6 | 6 | 12 | 18 | 24 |
| STRAIGHT | 2 | 4 | 8 | 12 | 16 |
| THREE-OF-A-KIND | 1 | 3 | 6 | 9 | 12 |
| TWO PAIR | 1 | 2 | 4 | 6 | 8 |
| JACKS OR BETTER | 1 | 1 | 2 | 3 | 4 |

Table 3 shows a suitable pay table that is used with the duplicated second hand when playing a basic Jacks or Better poker format and indicates the payout amounts when the player has selected the correct winning outcome.

TABLE 3

JACKS OR BETTER DRAW POKER

| | NUMBER OF COINS WAGERED | | | | |
|---|---|---|---|---|---|
| POKER HAND RANKING | 1 | 2 | 3 | 4 | 5 |
| STRAIGHT FLUSH | 10 | 25 | 50 | 100 | 200 |

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a poker game comprising:

a) a player making a first wager;

b) displaying a first hand of at least five cards all face up to the player;

c) after the first hand is displayed, providing the player with the opportunity of displaying a secondhand by making at least a second wager and selecting one or more of the cards from the first hand as cards to be displayed in at least a second hand;

d) the player selecting none, one or more of the face up cards from the first hand as cards to be held;

e) the player selecting none, one or more of the face up cards from the second hand as cards to be held;

f) displaying at least the first final hand and the second final hand by discarding from the first hand and second hand the face up cards that were not selected to be held and replacing each of those cards with a face up card;

g) determining the poker hand ranking of the first final hand and awarding the player a first amount based on a first pay table; and h) determining the poker hand ranking of the second final hand and awarding the player a second amount based on a second pay table.

2. A method of playing a poker game comprising:

a) a player making a first wager;

b) displaying a first hand of at least five cards all face up to the player;

c) after the first hand is displayed, providing the player with the opportunity of displaying a secondhand by making at least a second wager and selecting one or more of the cards from the first hand as cards to be displayed in at least a second hand;

d) providing the player with the opportunity to make at least a third wager and selecting at least one winning outcome for at least the first hand;

e) the player selecting none, one or more of the face up cards from the first hand as cards to be held;

f) the player selecting none, one or more of the face up cards from the second hand as cards to be held;

g) displaying at least the first final hand and the second final hand by discarding from the first hand and second hand the face up cards that were not selected to be held and replacing each of those cards with a face up card;

h) determining the poker hand ranking of the first final hand and awarding the player a first amount based on a first pay table;

i) determining the poker hand ranking of the second final hand and awarding the player a second amount based on a second pay table; and j) determining a match ranking of the winning combination selected and the outcome of the first hand and awarding the player a third amount based on a third pay table.

* * * * *